United States Patent [19]

West

[11] 4,031,666

[45] June 28, 1977

[54] ROTARY DOOR BLAST CHAMBER

[75] Inventor: Curtis C. West, Mishawaka, Ind.

[73] Assignee: Wheelabrator-Frye, Inc., Mishawaka, Ind.

[22] Filed: Aug. 30, 1976

[21] Appl. No.: 718,616

[52] U.S. Cl. ..... 51/419; 51/425; 51/426

[51] Int. Cl.[2] ..... B24C 3/14

[58] Field of Search ..... 51/8 R, 8 C, 8 SR, 9 R, 51/14, 15 R; 15/306 B; 134/114, 77–81; 220/253

[56] References Cited

UNITED STATES PATENTS

| | | | |
|---|---|---|---|
| 1,932,593 | 10/1933 | McEwan | 134/81 X |
| 2,351,272 | 6/1944 | Tourneau | 51/15 |
| 3,742,650 | 7/1973 | Graf | 51/14 X |

*Primary Examiner*—Gary L. Smith
*Attorney, Agent, or Firm*—McDougall, Hersh & Scott

[57] ABSTRACT

A blast chamber is disclosed which employs a rotary cylinder having openings therein for permitting the entry and exit of a part to be blast cleaned. The cylinder is enclosed in a housing in such a manner that when the openings through the housing and cylinder are aligned, a part to be cleaned can enter or exit the chamber. When the openings are misaligned, the chamber is sealed to prevent the escape of particulate during the blast process. The invention is suitable for use with a conveyor system for substantially continuous operation.

8 Claims, 7 Drawing Figures

ROTARY DOOR BLAST CHAMBER

BACKGROUND OF THE INVENTION

This invention relates to the field of blast cleaning devices. More particularly, it relates to blast chambers for enclosing an area in which blast cleaning is to be carried out. Blast cleaning is utilized for removing burrs and other imperfections from castings and the like. It is usually accomplished by projecting particulate, such as steel shot, grit or other abrasive, at high velocity against the surface to be cleaned. In order to permit recovery of the spent particulate for reuse and further in order to protect against injury from the high velocity abrasive, the cleaning process is usually conducted in a closed chamber.

Typical prior art blast enclosures are of the batch type. That is, the chamber is opened, the parts are placed in the chamber manually and then the chamber is sealed. Blasting is then carried out and after treatment the parts are removed by manual operation. It is, of course, desirable to automate this process in order to achieve improved efficiency and lower costs. In particular, it is desirable to devise a means whereby a conveyor system can be employed for moving parts into and out of a blast enclosure. The present invention provides such a means.

Is is accordingly an object of the invention to provide a novel blast enclosure which is suited for use with a conveyor system.

Another object of the invention is to provide a rotary door blast enclosure which permits entry and exit of cast parts.

A further object of the invention is to provide a blast enclosure which can be operated in conjunction with an automated monorail conveyor system.

Other objects and advantages of the invention will be apparent from the remaining portion of the specification.

DETAILED DESCRIPTION

Figure 1:
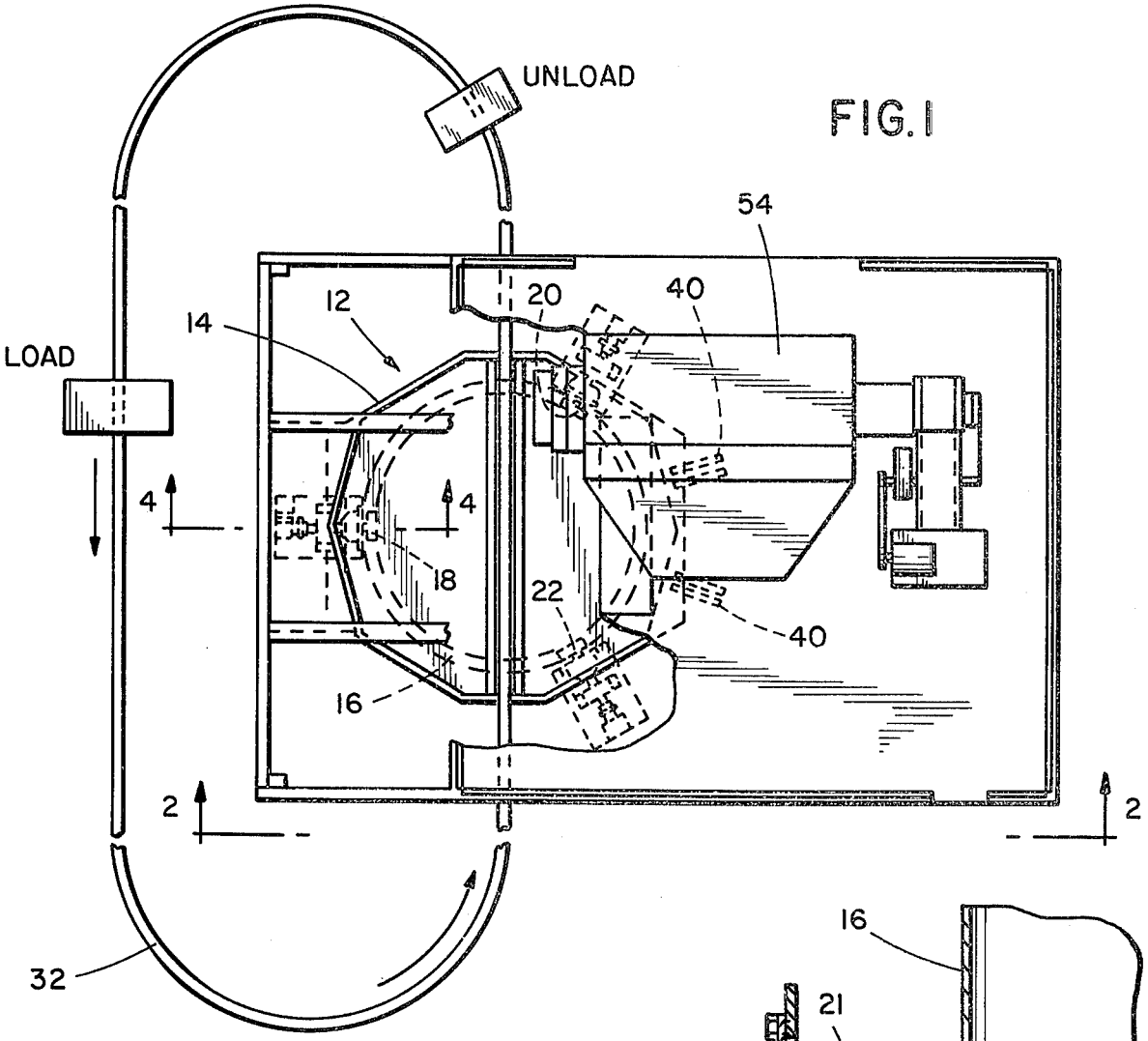
FIG. 1 is a plan view of a typical conveyor system employing the rotary door blast chamber according to the invention.
Figure 4:
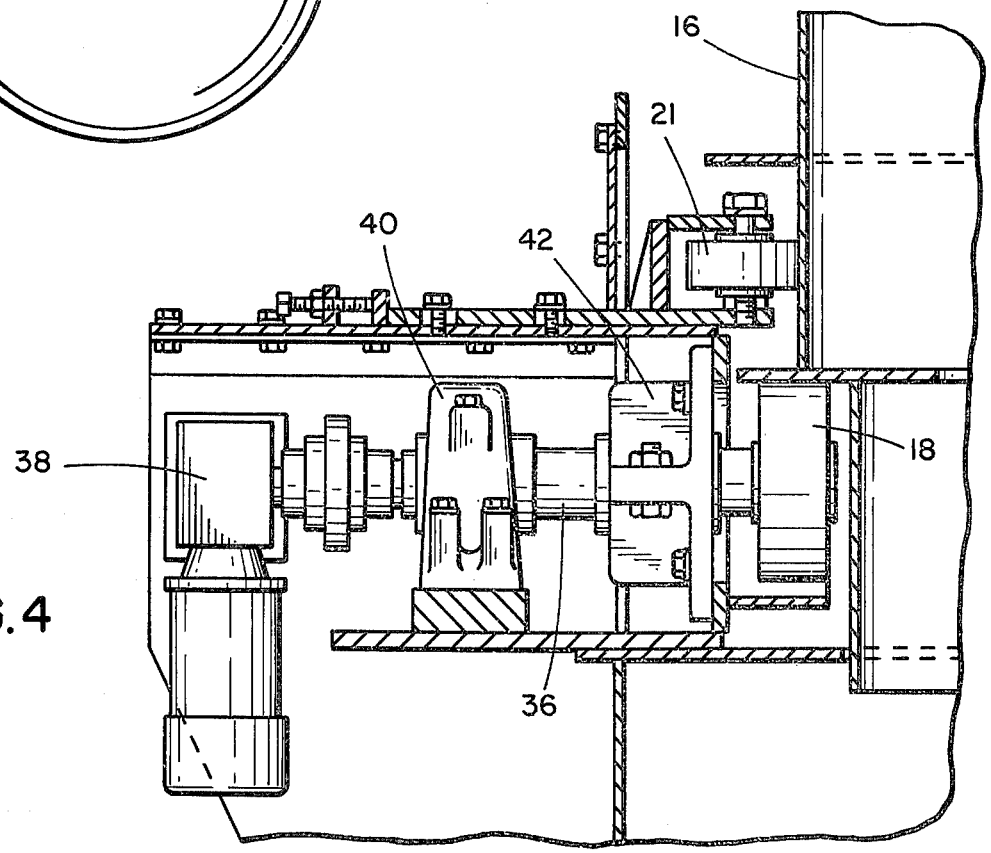
FIG. 4 is a sectional view along the lines 4—4 of FIG. 1 illustrating the drive mechanism for the rotary door cylinder.
Figure 3:
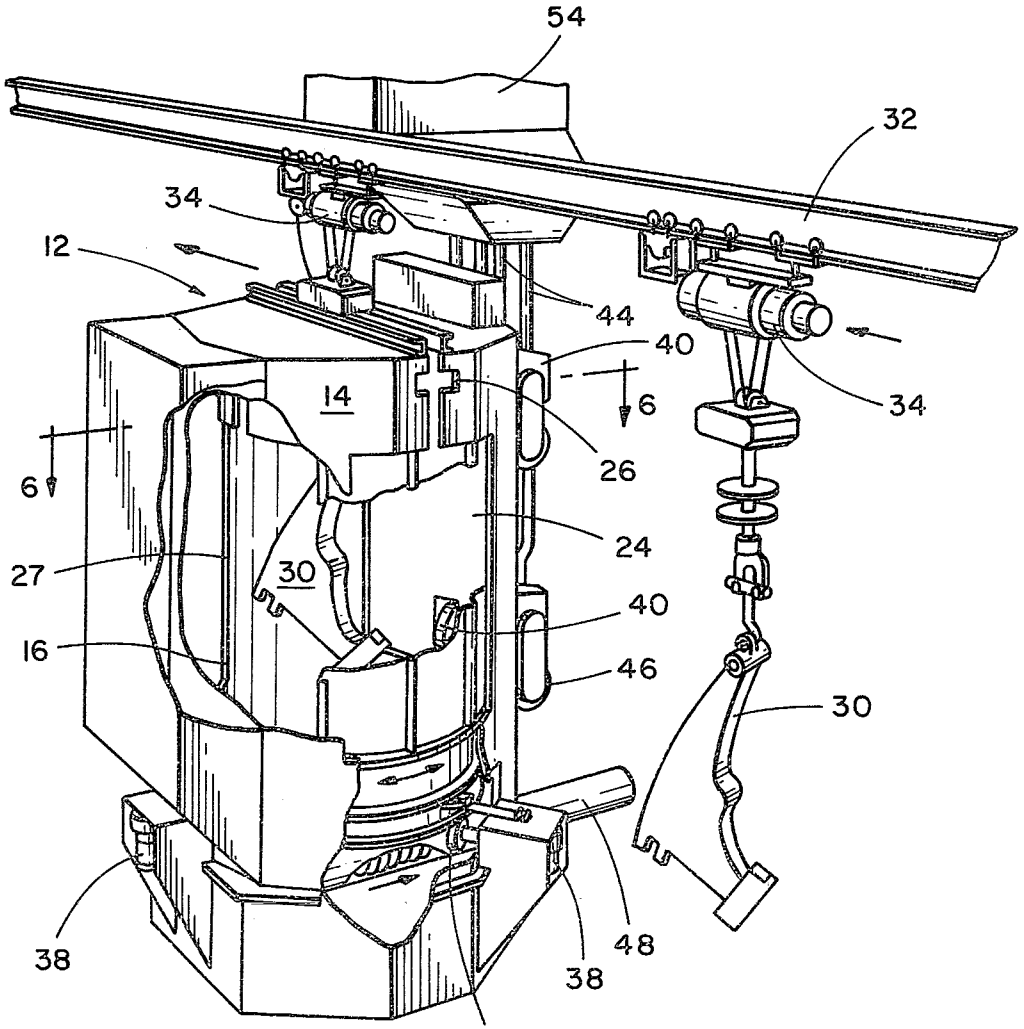
FIG. 3 is a perspective view of the blast chamber according to the invention indicating the manner in which parts enter and exit the chamber.

Referring to FIGS. 1 and 3, there is disclosed a blast treatment system. An overhead monorail conveyor system is employed for carrying parts to be blast treated from a load station to the blast chamber 12 and finally to an unload station. The blast chamber according to the invention consists of an outer structure of housing 14 and an inner cylinder 16. The inner cylinder is mounted for rotation on a set of rollers 18, 20 and 22 equally spaced around the circumference of the cylinder. As best seen in FIG. 4, the cylinder 16 is supported on the roller 18 whereby rotation of the roller is effective for rotating the cylinder. Auxiliary rollers 21 maintain proper positioning and movement of the rotary cylinder 16.

Figure 2:
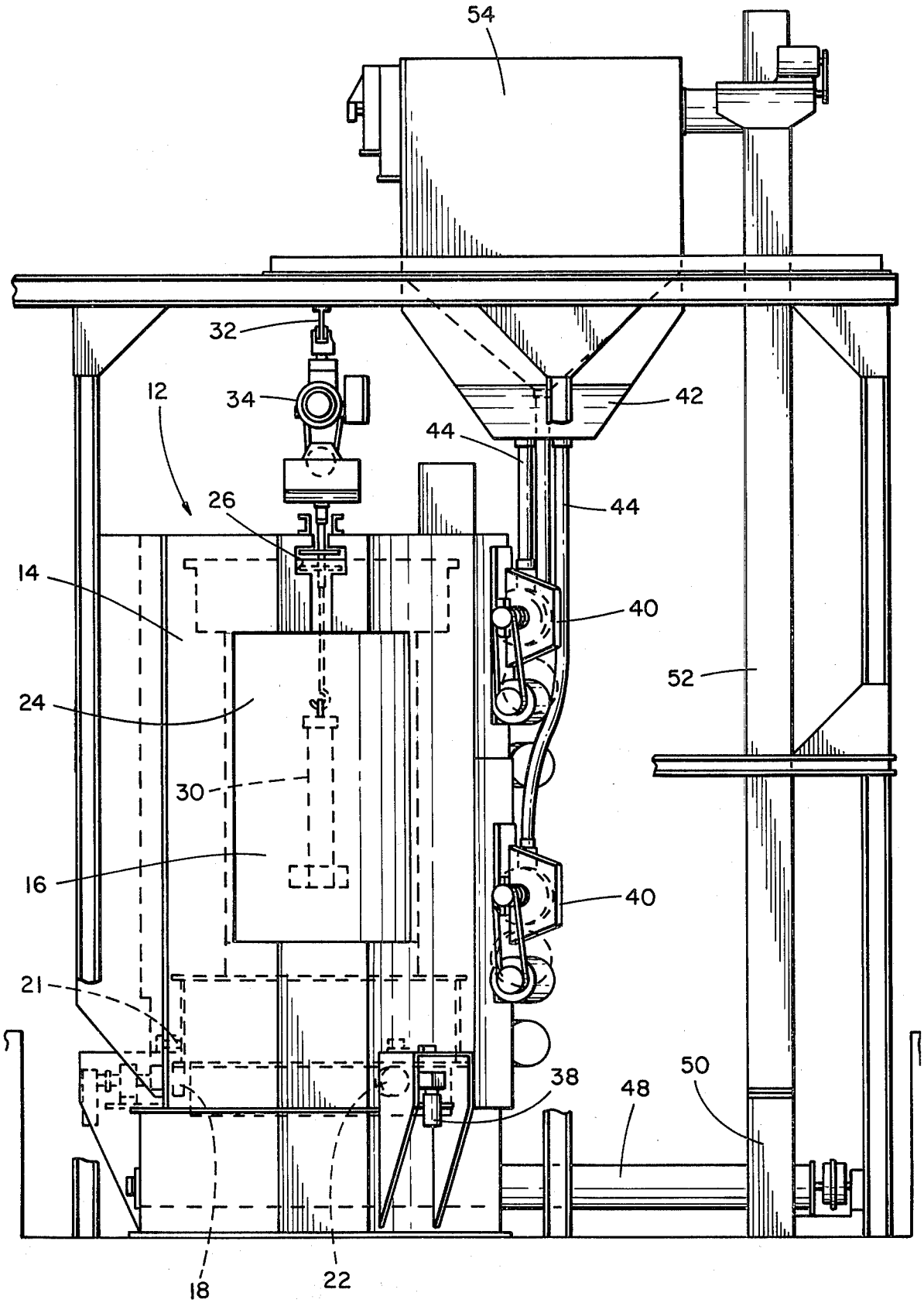
FIG. 2 is a side elevational view along the lines 2—2 of FIG. 1.

Referring to FIGS. 2 and 3, it will be seen that there is provided through the outer housing 14 an opening 24 including a t-shaped keyway 26. A similar opening is provided at the rear of the housing 14. Similar, although not identical, openings 27 are provided in the rotary cylinder 16 so that when the two sets of openings are aligned, as indicated in FIG. 2, a part can enter or exit the blast chamber.

In FIG. 3 a part 30 is illustrated suspended from a monorail conveyor 32 on a motor driven carrier 34. The carrier 34 is capable of linear movement along the monorail as well as rotational movement of the part suspended therefrom. The details of construction of the monorail, the motor driven carrier, and the means for translational and rotational movement are conventional and form no part of the present invention. A manually operated carrier can be employed in which the blast chamber is opened and the carrier then moved into the chamber as with prior blast enclosures. Alternatively, if desired, the motor driven carrier 34 may be electrically controlled by a series of limit switches. In such an instance the motor driven carrier would move into the enclosure at the completion of a previous blasting cycle, spin the part during blast treatment and move out of the enclosure at the completion of the blast cycle.

Irrespective of the type of carrier employed, it will be clear that when the opening 27 through the rotary cylinder 16 is aligned with the openings 24 through the housing 14, entry and exit from the blast chamber is permitted. After the entry of a part to be cleaned the rotary cylinder 16 is rotated, in a manner to be described, so as to misalign the openings between the cylinder and the housing. This closes the chamber preventing escape of particulate therefrom. Referring to FIG. 4, it will be seen that one of the three rollers on which the cylinder is supported is motor driven. In particular, roller 18 is connected by a drive shaft 36 to a motor 38. Shaft 36 is supported in bearings 40 and 42. As indicated with respect to the operation of the monorail conveyor, the system can be automated or manually operated. Thus, operation of motor 38 and the corresponding movement of the rotary cylinder 16 may be controlled in a number of ways. When motor 38 is activated, roller 18 causes movement of the rotary cylinder. In the case of loading the blast chamber the motor is operated until the cylinder openings 27 are in alignment with the openings through the housing. The part 30 carried by the motor driven carrier is then conveyed into the interior of the chamber. The motor is again operated to move the cylinder 16 to a position wherein its openings are misaligned with respect to the housing. The blast operation then begins.

Figure 5:
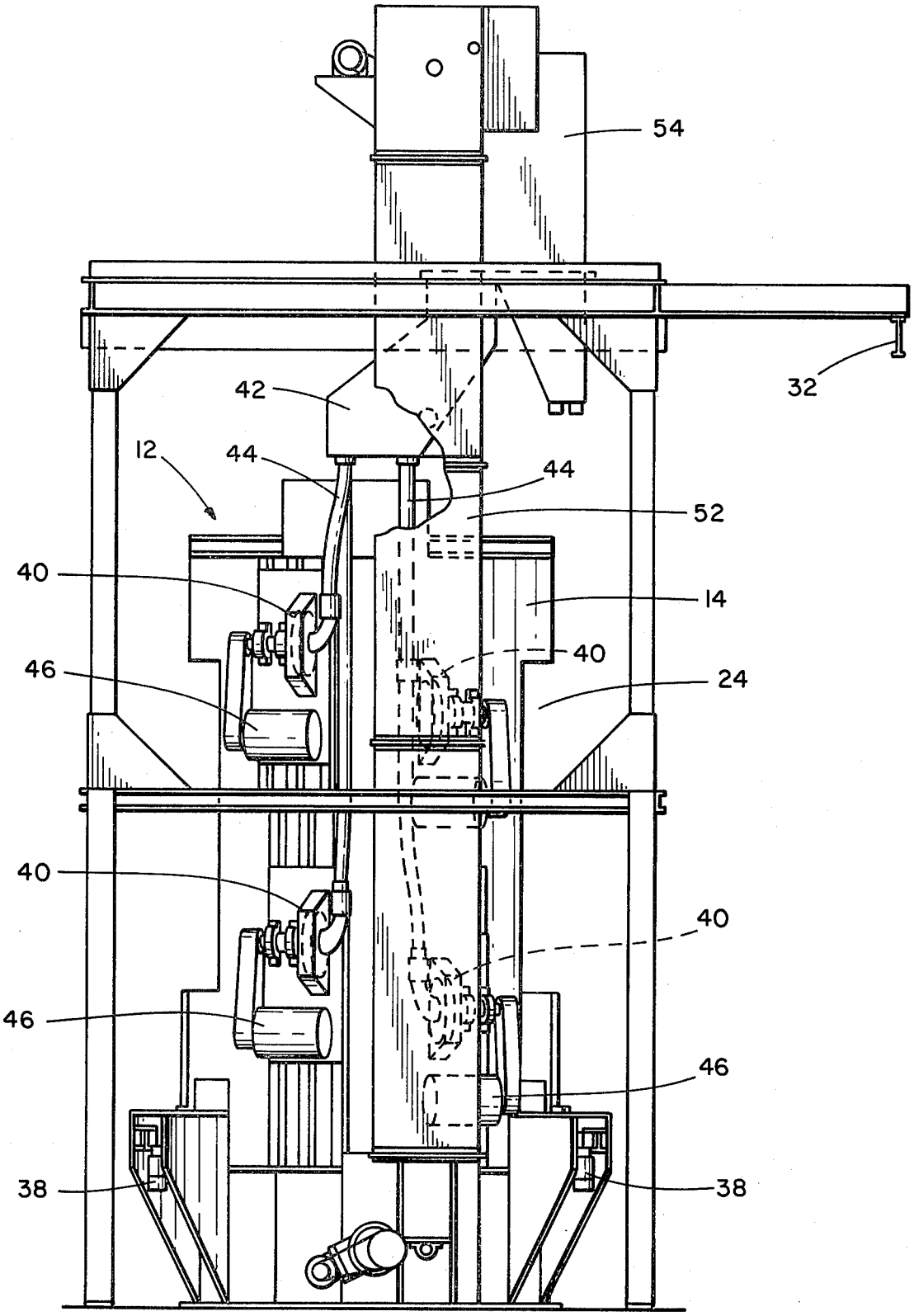
FIG. 5 is a rear elevation of the device indicating the details of the blasting equipment projecting into the interior of the chamber.

As illustrated in FIGS. 2 and 5, the blasting operation may be carried out by use of airless centrifugal throwing wheels of the type manufactured by the Materials Cleaning Systems Divisions, Wheelabrator-Frye, Inc., Mishawaka, Indiana. These devices, four of which are illustrated in the present example, employ a throwing wheel 40 for projecting particulate supplied from a hopper 42 via conduits 44. The wheels project the abrasive into the interior of the rotary cylinder through one of the openings 27 through the cylinder. In this manner the part contained within the cylinder is subjected to a high velocity abrasive blast. The blasting wheels are belt driven by motors 46 and are mounted through the housing 14.

The abrasive, after striking the part, drops to the bottom of the blast chamber and is collected in a trough-like enclosure. By means of a screw conveyor 48, illustrated schematically in FIG. 2, the spent abrasive is conveyed to the boot 50 of a belt and bucket elevator 52. Elevator 52 carries the abrasive and any foreign matter, such as dirt, burrs, and the like, to the intake of an air wash separator 54. The air wash separator, in a manner well known in the art, separates the abrasive from the waste materials and returns the former to the abrasive supply hopper 42 for reuse.

Figure 6:
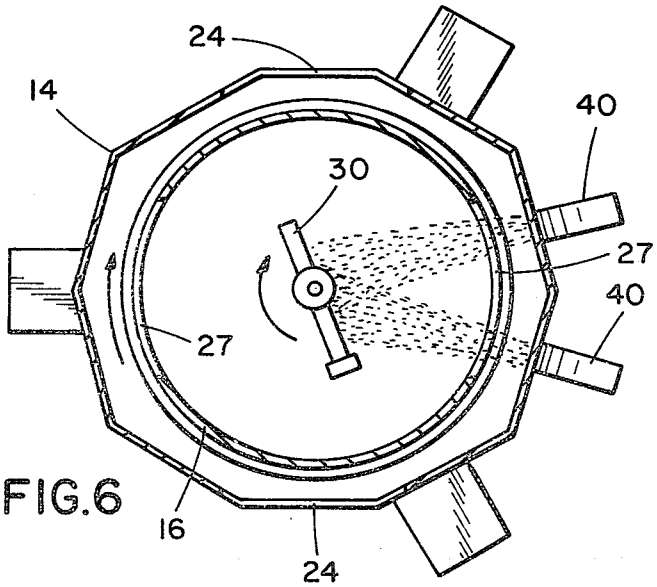
FIG. 6 is a sectional view along the lines 6—6 of FIG. 3 illustrating the position of the door cylinder during blast treatment.
Figure 7:
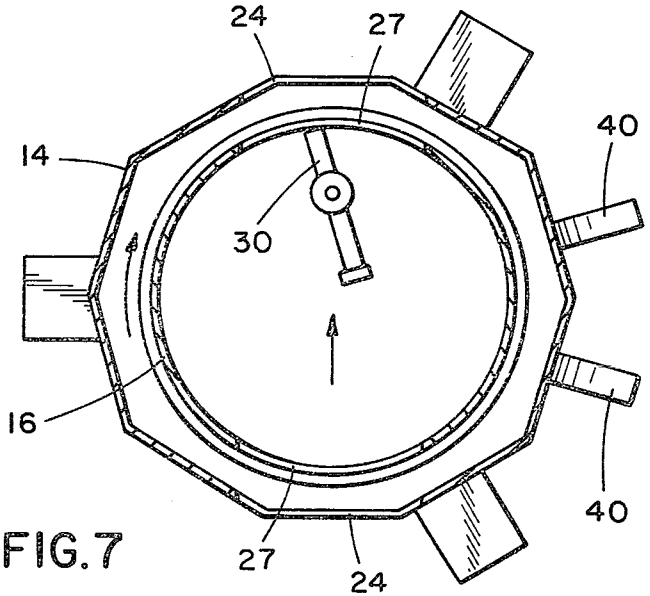
FIG. 7 is a view similar to FIG. 6 illustrating the door cylinder position for entry and exit to and from the chamber.

Referring to FIG. 6, operation of the system is illustrated. As indicated, the part 30 is rotated by the motor driven carrier during the period in which it is enclosed within the blast chamber. Note that during this time the openings 27 through the rotary cylinder 16 are not aligned with respect to the openings 24 on the housing 14. Thus, the particulate cannot escape from the blast chamber. Also note that the particulate passes into the chamber through one of the openings 27. In FIG. 7 a similar view is shown at a point in time, however, when the blast wheels are inoperative and the part 30 is being removed from the chamber. Due to the rotation of the cylinder 16 by approximately 90° from the FIG. 6 position, the cylinder openings 27 are now aligned with the openings 24 permitting exit of the part from the chamber.

As indicated previously, the blast enclosure of the invention can be utilized for a manual operation, such as has been known in the prior art. However, it is well suited to use in an automated system wherein the movement of the carriers, rotation of the cylinder 16 and operation of the blasting wheels is automatically sequenced. In such an installation, due to the advantages of the present construction, up to 20 parts per hour can easily be accommodated.

While I have shown and described embodiments of this invention in some detail, it will be understood that this description and illustrations are offered merely by way of example, and that the invention is to be limited in scope only by the appended claims.

I claim:

1. A sealable chamber for blast cleaning parts with particulate comprising:

a. an enclosed housing having a pair of aligned openings therethrough to permit entry and exit of said parts;

b. a hollow cylinder disposed within said housing having a pair of openings therethrough corresponding to the openings in said housing;

c. means for supporting and rotating said cylinder between a first position in which said housing and cylinder openings are aligned to permit entry and exit of parts from said chamber and a second position in which said housing and cylinder openings are misaligned to seal the chamber against the escape of said particulate.

2. The device of claim 1 further including an overhead conveyor system for moving the parts into and out of said chamber, said housing and cylinder having additional openings therethrough to permit passage of the conveyor through the chamber.

3. The device of claim 1 wherein said blast cleaning is accomplished by at least one centrifugal throwing wheel projecting the particulate at a high velocity at the interior of said chamber.

4. The device according to claim 3 wherein said throwing wheels are mounted on said housing and project the particulate through one of said openings in said cylinder when said cylinder is in the second position.

5. The device according to claim 3 further including means for recovering the spent particulate and returning it to the throwing wheels for further use.

6. The device according to claim 5 wherein said recovery means includes:

a. a particulate collecting trough at the bottom of said chamber;

b. a particulate elevator;

c. a screw conveyor moving the particulate from the trough to the elevator;

d. an air wash separator receiving the particulate for removing dirt and debris therefrom.

e. hopper means receiving the separated particulate and returning it to the throwing wheels.

7. The device according to claim 1 wherein said supporting means include:

a. at least three support rollers spaced beneath said cylinder to support and rotate said cylinder;

b. a motor and drive train connected to one of said support rollers, whereby the said one support roller is rotated by operation of said motor and drive train to position said cylinder in said first and second positions.

8. The device according to claim 7 further including at least three auxiliary rollers vertically positioned and in contact with said cylinder to maintain it in proper position during rotation thereof.

* * * * *